United States Patent [19]

Lee et al.

[11] 4,222,499

[45] Sep. 16, 1980

[54] PRESSURIZED FLUID DISPENSING APPARATUS HAVING EXPANSIBLE BLADDER HELD IN PLACE WITH COMPRESSIVE FORCES

[75] Inventors: Harold D. Lee, Beaumont, Tex.; Darryl L. Carimi, New Orleans, La.

[73] Assignee: Kain's Research & Development Company, Inc., Gretna, La.

[21] Appl. No.: 37,931

[22] Filed: May 7, 1979

Related U.S. Application Data

[63] Continuation of Ser. No. 808,970, Jun. 22, 1977, abandoned, which is a continuation-in-part of Ser. No. 652,659, Jun. 4, 1976, abandoned.

[51] Int. Cl.[3] ..... B67D 5/06

[52] U.S. Cl. ..... 222/183; 222/215; 222/386.5

[58] Field of Search ..... 222/94, 95, 105, 107, 222/183, 212–215, 386.5, 387, 389, 567, 569, 570; 138/30

[56] References Cited

U.S. PATENT DOCUMENTS

| | | | |
|---|---|---|---|
| 2,715,980 | 8/1955 | Frick | 222/212 X |
| 3,225,967 | 12/1965 | Heimgartner | 222/105 X |
| 3,256,911 | 6/1966 | Mercier et al. | 138/30 |
| 3,506,005 | 4/1970 | Gilio et al. | 222/215 X |
| 3,608,781 | 9/1971 | Flynn | 222/94 |
| 3,738,538 | 6/1973 | Roper et al. | 222/212 X |
| 3,876,115 | 4/1975 | Venus, Jr. et al. | 222/212 X |
| 3,961,725 | 6/1976 | Clark | 222/215 |

*Primary Examiner*—Robert J. Spar
*Assistant Examiner*—Fred A. Silverberg
*Attorney, Agent, or Firm*—Vinson & Elkins

[57] ABSTRACT

An apparatus for pressurized dispensing of fluid products comprising an elastomeric pressure unit, a support, a sealing member, and a valve and which may additionally include either a container for a housing around the pressure unit or a liner within the pressure unit. The elastomeric pressure unit has an internal cavity which contains the fluid product and also provides the dispensing pressure. An assembly of such an apparatus is obtained without bonded connection and without the requirement of an additional sealing member when a liner is used.

14 Claims, 12 Drawing Figures

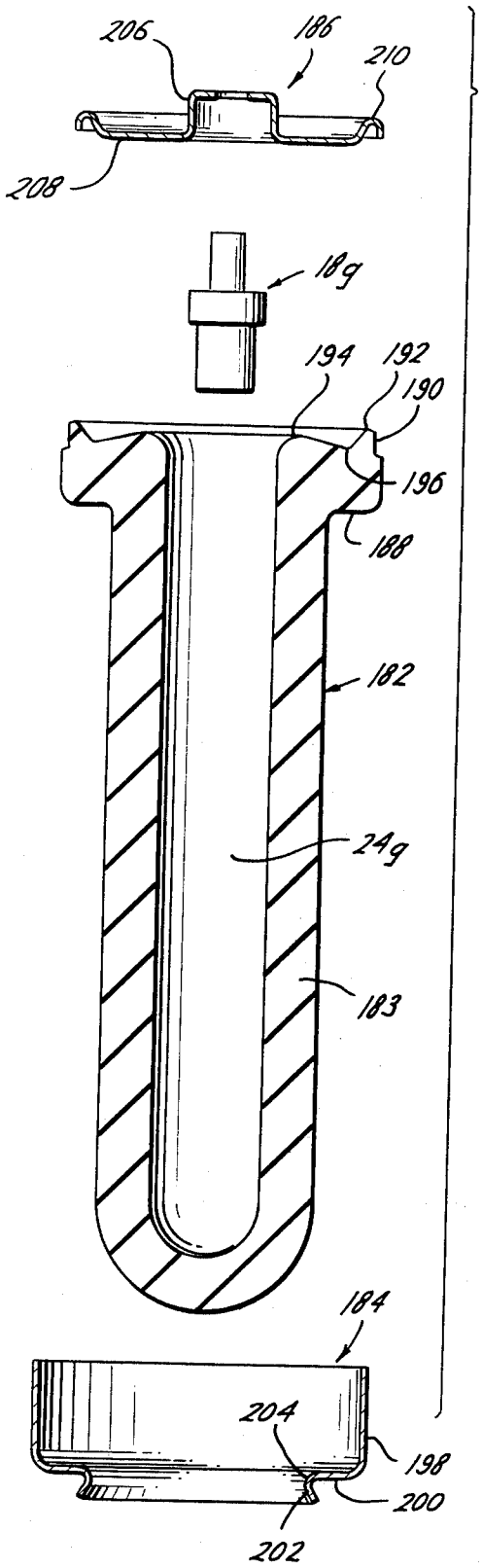
Fig. 11
Fig. 12
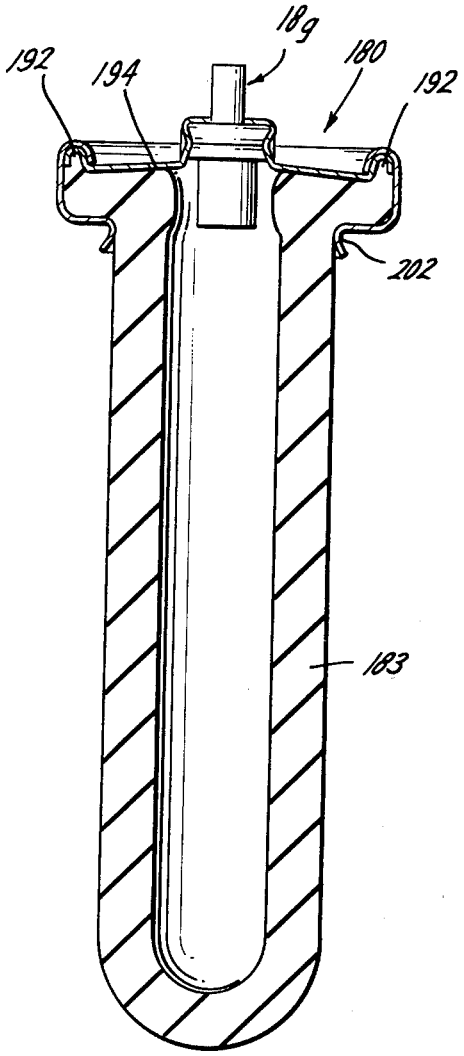

PRESSURIZED FLUID DISPENSING APPARATUS HAVING EXPANSIBLE BLADDER HELD IN PLACE WITH COMPRESSIVE FORCES

This is a continuation of prior co-pending patent application Ser. No. 808,970, filed June 22, 1977, now abandoned, which was a continuation-in-part of prior co-pending application, Ser. No. 652,659, filed June 4, 1976, now abandoned.

BACKGROUND OF THE INVENTION

1. Field of the Invention

This invention relates to pressurized fluid product dispensing apparatus. More particularly, it relates to apparatus for pressurized dispensing of fluid products, including very fine powders, in which the dispensing pressure is provided by the inherent contracting force of an expanded pressure unit.

2. The Prior Art

The use of pressure units, such as an elastomeric body, to contain a fluid product and to provide the fluid dispensing pressure is disclosed in the U.S. patents of Calvin L. Kain, entitled "CONTAINER FOR PRESSURE DISPENSING OF FLUID", No. 3,940,026, and "APPARATUS FOR PRESSURE DISPENSING OF FLUID" No. 4,121,737.

Both of these prior applications disclose bonding the upper end of the elastomeric pressure unit to the valve support to provide a fluid-tight connection therebetween. Also U.S. Pat. No. 4,121,737 shows the use of a liner inside the elastomeric pressure unit to contain the product and protect it from contamination by contact with the elastomeric pressure unit. However, the attachment of the liner requires additional sealing means.

While the fluid dispensing apparatus, as disclosed in such prior applications, are entirely satisfactory and functional, the use of bonded connections between the elastomeric pressure unit and the valve support, and the required use of additional sealing means when a liner is used, all increase the cost of production, provide the possibility for manufacturing defects and require detailed inspection procedures to assure that each bond is complete and fluid-tight. Since pressurized fluid dispensing apparatus are generally disposable, it is desirable to keep the manufacturing cost of the apparatus as low as possible. It is also desirable that such an apparatus be simple to manufacture and assemble to reduce the possibility of manufacturing defects.

The U.S. Pat. No. to Venus, et al 3,876,115 discloses analogous fluid dispensing apparatus utilizing dual nested pressure members formed of relatively thin-walled elastomeric material. In the Venus, et al apparatus, the pressure members are provided with upper sealing flanges which are trapped between upper and lower retaining members to provide a fluid seal. However, because of the relatively thin-walled material utilized for the pressure members, the upper and lower retaining members must be provided with mating grooves and projections for locking the pressure members into place and preventing their being pulled out of place when the unit is inflated.

OBJECTS OF THE INVENTION

An object of this invention is to provide a gasless pressurized fluid dispensing apparatus with a more simplified and economical structure than that previously known and which is an improvement over the prior applications referred to above.

Another object of this invention is to provide such gasless, pressurized fluid dispensing apparatus which may be assembled entirely by frictional engagement, or force fitting, of the various parts.

Another object of this invention is to provide a gasless, pressurized fluid dispensing apparatus with a simplified sealing connection around the opening into the elastomeric pressure unit which does not require bonding.

Another object of this invention is to provide a gasless, pressurized fluid dispensing apparatus with a simplified sealing connection around the opening into the elastomeric pressure unit which permits the use of a liner without requiring bonding or auxiliary sealing means.

Another object of this invention is to provide a gasless, pressurized fluid dispensing apparatus with a simplified sealing connection around the opening into the elastomeric pressure unit and with a simplified attachment of the pressure unit to the surrounding container, neither of which require bonding or mating projections and grooves for retaining the pressure unit in place.

These and other objects and features of advantage of the present invention will be apparent from the drawings, detailed description, and the appended claims.

BRIEF DESCRIPTION OF THE DRAWINGS

In the drawings wherein like numerals indicate like parts and wherein several illustrative embodiments of this invention are shown:

FIG. 11 is an exploded view in vertical cross section of a sixth embodiment showing a modification of the pressure unit, support and sealing members; and FIG. 12 is a view in vertical cross section of the parts of FIG. 11 in assembled position.

DESCRIPTION OF THE PREFERRED EMBODIMENT

Figure 1:
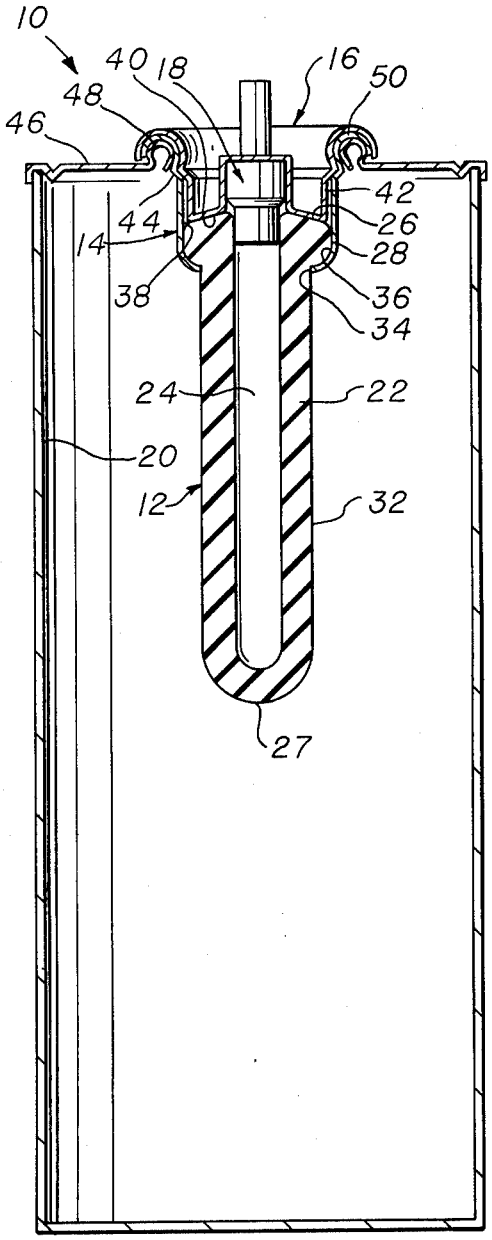
FIG. 1 is a view in vertical cross section of a first embodiment of a pressurized fluid dispensing apparatus housed within a container, with the apparatus empty and ready to be filled with fluid product.

The improved apparatus for pressurized dispensing of fluids, generally indicated at 10, provides a novel technique for supporting a relatively thick-walled elastomeric pressure unit and sealing around the opening into the internal cavity of the pressure unit without bonding. The improved pressurized fluid dispensing apparatus 10 includes a pressure unit 12 which, as will be explained, exerts the force for dispensing products, support means 14, sealing member means 16 and valve means 18; in most instances, the apparatus will also include a container 20 within which the parts are housed for each handling and use of the apparatus 10.

The container 20 will be subject to little, if any, stress loading due to the pressence of pressurized fluid within the pressure unit 12. Therefore container 20 may be constructed from any desired material including metal, cardboard, or plastic. Additionally, container 20 may be of any desired configuration, such as the cylindrical container 20 illustrated, although other shapes may be used.

Figure 3:
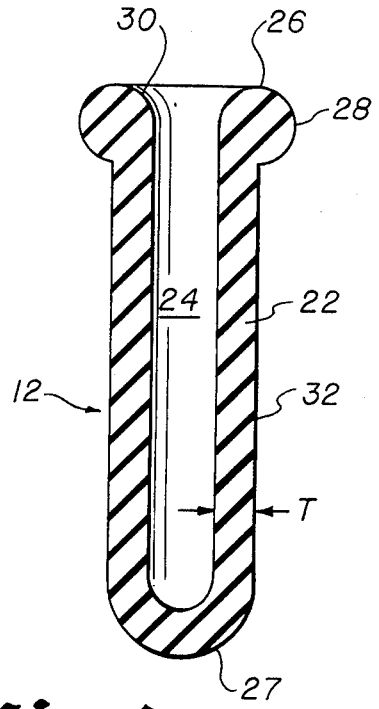
FIG. 3 is an enlarged detailed view in vertical cross section of the elastomeric pressure unit of FIG. 1 in its fully relaxed condition prior to being assembled with the remaining parts of the apparatus.

Pressure unit 12 is illustrated in detail in FIG. 3. It includes an elongate body 22 of generally cylindrical configuration formed with an internal cavity 24 extending downwardly from an opening 26 in the upper end of the pressure unit. Cavity 24, when expanded, contains the fluid to be dispensed by the apparatus. The pressure unit includes an elongate generally cylindrical lower portion 32 which comprises the major portion of the longitudinal dimension of the pressure unit. The pressure unit throughout such lower portion is formed with a substantially uniform wall thickness T between its outer surface and its inner surface defining the internal cavity 24. The wall thickness T will vary depending upon the dispensing pressure desired, but will always be sufficient to provide a dispensing pressure of at least 25 to 30 pounds per square inch, which with known elastomeric materials requires a thickness T of at least about one-tenth to one-eighth of an inch.

The upper end of the elastomeric body 22 in surrounding relationship to the opening 26 of cavity 24 is provided with an enlarged and generally rounded portion 28 of substantially increased wall thickness. In most instances upper portion 28 will be approximately twice as thick as the lower portion 32 and will have a vertical dimension, or height, approximately equal to its wall thickness, so as to render it relatively more rigid than lower portion 32. The shape of the enlarged upper portion 28 is such as to provide a flared on curved surface 30 which merges into the wall of the internal cavity 24. This provides a smooth rounded surface against which the upper portion or neck of a liner within the cavity may be supported in flared position for sealing engagement (as explained more fully hereinafter). The rounded top surface of enlarged portion 28 provides a line contact point of maximum compression for sealing engagement with the parts of the apparatus in fully assembled position. The elongate lower portion 32 of the body 22 is expanded when the internal cavity 24 is filled with fluid product. After expansion the pressure unit 12 exerts a force upon the contents tending to discharge them from the internal cavity 24. The amount of force may be varied by varying the wall thickness, T, of the elongate lower body portion 32.

A fluid tight arrangement for the pressure unit 12 and valve means 18, which controls the dispensing of product from the internal cavity 24, is obtained with a novel interaction of the pressure unit 12, support means 14 and sealing member means 16. As explained more fully hereinafter, the mating surface on the support means 14 and pressure unit 12 are shaped so as to approximately conform one to the other for secure seating of the pressure unit while the mating surfaces on the sealing member means 16 and pressure unit 12 are of non-conforming shape so as to provide annular areas of maximum compression therebetween for proper sealing engagement.

Figure 2:
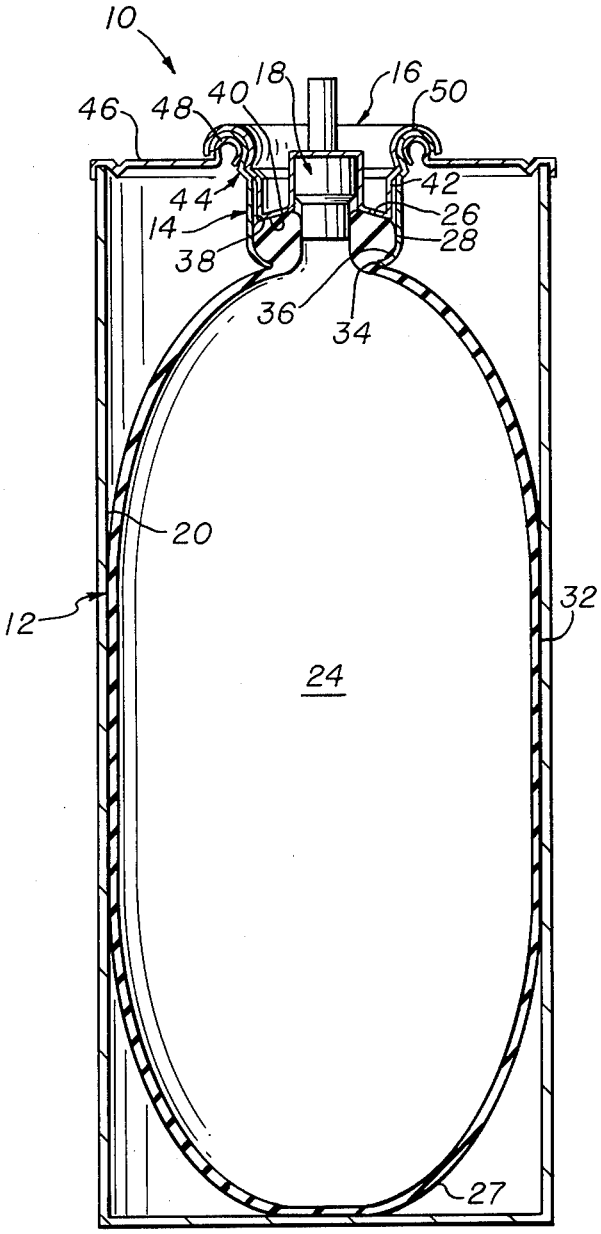
FIG. 2 is a view similar to FIG. 1, showing the apparatus in its fully expanded, filled condition.
Figure 5:
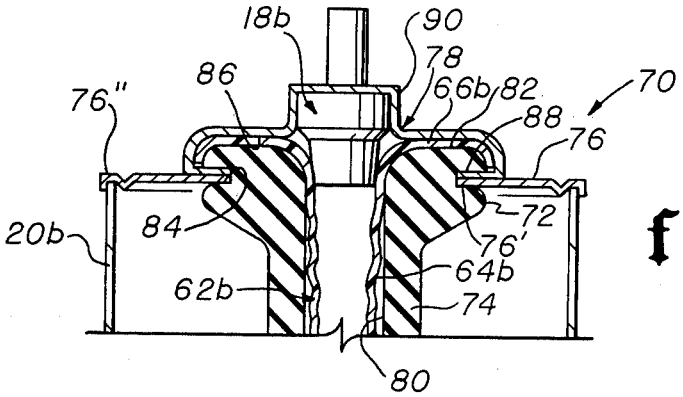
FIG. 5 is a fragmentary view in vertical cross section of the upper portion of a second embodiment with an alternate support and sealing member.

As shown in FIG. 1, the support means 14 has a central opening 34 sized to permit the elongate portion 32 of elastomeric body 22 to pass therethrough when the elastomeric body 22 is in its relaxed configuration. Surrounding the central opening 34 is a seating surface 36 upon which the bottom of the enlarged portion 28 of the elastomeric body 22 may set. Preferably, seating surface 36 is configured to approximately conform to the external configuration of the bottom part of enlarged portion 28 of elastomeric body means 22. Thus the seating surface 36 may be concave to support a convex enlarged portion 28, as illustrated in FIG. 2, or may be flat to support a pressure unit with a flat lower surface on its enlarged upper portion, as illustrated in FIGS. 5, 11 and 12. In the embodiment shown in FIGS. 1 and 2, extending upwardly from the seating surface 36 is a cylindrical portion 38 of the support means 14 which interacts with the sealing member means 16, in a manner to be described, to maintain sealing member means 16 in its position as part of the fluid tight arrangement.

The sealing member means 16 illustrated in FIGS. 1 and 2 includes an annular portion 40 surrounding the open end 26 of the pressure unit 14 for applying a compressive force to the rounded top of enlarged portion 28 of elastomeric body means 22 to effect a sealing of the open end 26 of the elastomeric body 22. A fluid tight seal is therefore obtained between the open end 26 of the body 22 and sealing member means 16 by compressibly squeezing the enlarged portion 28 of the body 22 between the annular portion 40 of sealing member means 16 and the seating surface 36 of support means 16. Maximum compression is obtained along a line defined by the uppermost point of the rounded surface 30 of enlarged portion 28 to thereby produce maximum sealing engagement between the two surfaces along such line. Sealing member means 16 is maintained in sealing contact with the open end 26 of the elastomeric body 22 by a fixed engagement of it with support means 14. The fixed engagement occurs between a cylindrical portion 42 of sealing member means 16 and the cylindrical portion 38 of support means 14. When sealing member means 16 has been positioned to effect a sealing of the open end 26 of the elastomeric body 22, a fixed engagement of it with support means 14 is effected as by crimping together, at crimp 44, the cylindrical portion 42 of sealing member means 16 and the cylindrical portion 38 of support means 14.

Valve means 18 is sealed to and carried by sealing member means 16 and provides a fluid passageway therethrough between the internal cavity 24 and the exterior of the fluid pressure dispensing apparatus 10. Valve means 18 may be of a type disclosed in the aforementioned U.S. Pat. No. 3,940,026, the entire disclosure of which is hereby incorporated by reference. Valve means 18 permits a selective dispensing of product from the internal cavity 24 and may permit product to be injected into the internal cavity 24.

When the container 20 is employed, a simple and effective attachment of support means 14 to the container 20 is illustrated in FIGS. 1 and 2. Container 20 includes an annular end plate 46 having a central opening surrounded by an annular rim portion 48 formed by rolling the metal of end plate 34 into a circular cross section. Support means 14 is disposed within the opening of the end plate 46. Support means 14 includes a curved downward facing lip portion 50 at one end of its cylindrical portion 38 adapted to coact with and be suspended from the rim portion 48.

To assemble the apparatus 10, the pressure unit 12, support means 14 and sealing member means 16 are interfitted to seal the open end 26 of the internal cavity 24. To do so, the elongate portion 32 of the pressure unit 12 is inserted through the central opening 34 of support means 14 until its enlarged portion 28 engages the support means seating surface 36. Sealing member means 16, carrying valve means 18, is positioned with its annular portion 40 surrounding the opening into the internal cavity 24 and applying a compressive force to enlarged portion 28. The compressive force transforms enlarged portion 28 from its rounded, unstressed configuration (see FIG. 3) to the FIG. 1 configuration and enables a fluid-tight seal to be obtained between the pressure unit 12 and sealing member means 16 without bonding. When sealing member means 16 is in position, a fixed engagement between it and support means 14 is provided as by crimping at crimp 44.

If a container 20 is used with the apparatus 10, support means 14 could be inserted within and attached to container 20 either before or after assembly of the subcombination comprising pressure unit 12, support means 14, sealing member means 16 and valve means 18. Support means 14 is attached to container 20 by fitting its curved lip portion 50 over the rim portion 38 of the container 20.

The fluid dispensing apparatus 10 is filled with fluid product through valve means 18. As the fluid product enters the internal cavity 24 the elastomeric body 22 expands. If the pressure unit 12 is housed within a container 20, the maximum size assumed by the pressure unit 12 will be the interior configuration of container 20.

In operation, the pressurized fluid dispensing apparatus 10 selectively dispenses fluid product from the internal cavity 24. The inherent contracting force of the expanded pressure unit provides the sole dispensing force for the fluid. Also, the pressure unit, because of its thick wall construction, functions without the use of mechanical tensioning means such as are used in most prior art devices. The contracting force provides dispensing pressure until the pressure unit 12 has returned to its relaxed configuration. The product is selectively dispensed through valve means 18. Once it has been dispensed, the apparatus 10 may be refilled through valve means 18 and used again.

Figure 4:
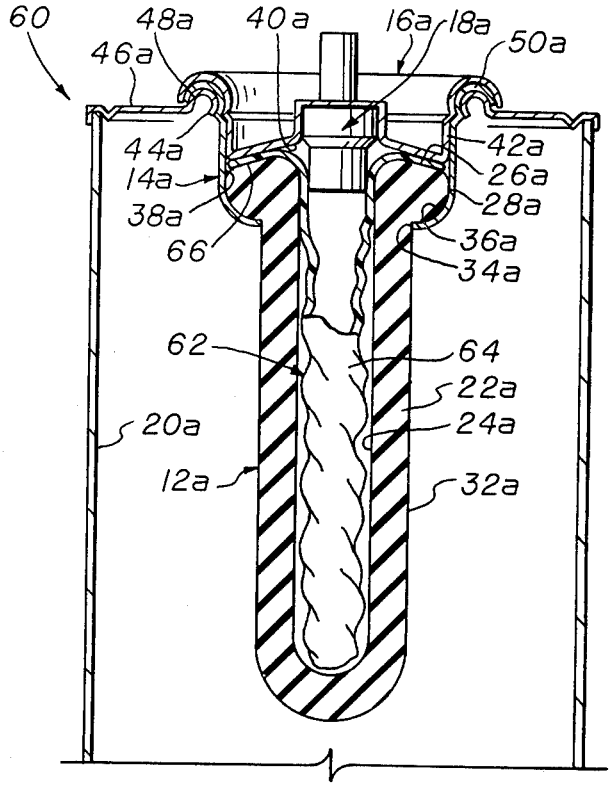
FIG. 4 is a fragmentary view in vertical cross section of the upper portion of the dispensing apparatus of FIG. 1 and illustrating the use of a liner therein.

The use of liner 62 to prevent contamination between the product and the elastomeric material of the pressure unit is illustrated in FIG. 4. All of the other elements of the pressurized fluid dispensing apparatus 60 of FIG. 4 are the same as the elements shown in FIGS. 1, 2 and 3. These corresponding elements are designated with the corresponding numeral in FIG. 4 with the addition of the suffix a.

Although a wide range of products may be contained within the internal cavity **24*a* of the pressure unit 12*a* without either damaging pressure unit 12*a* or themselves being adversely affected by the elastomeric material of pressure unit 12*a*, certain products are either chemically incompatible with the elastomeric material of pressure unit 12*a* or obtain an undesirable odor or flavor from the elastomeric material. When such products are used with the pressurized fluid dispensing apparatus 60 of this invention, liner means 62 (see FIG. 4) is disposed within the internal cavity 24*a* of pressure unit 12*a*. Liner means 62** may be of the type disclosed in the aforementioned U.S. Pat. No. 4,121,737, the entire disclosure of which is hereby incorporated by reference. It is formed of relatively inelastic material such as polyethylene film, and is thin-walled as compared to the pressure unit, generally having a wall thickness of only a few mils.

Liner means 62 is preferably flexible, relatively impermeable to the product, and compatible with the product. The size and configuration of the body 64 of liner means 62 is preferably equal to or slightly larger than that which it will assume when the apparatus 60 is filled. The liner body 64 will then not be stressed when the pressure unit **12*a* is in its fully expanded condition. Liner means 62 also includes a neck 66, which will be confined, in a sealing relationship, between sealing member means 16*a* and the enlarged portion 28*a* of the elastomeric body 22*a***.

To assemble the apparatus 60 when liner means 62 is used, liner body 64 is folded and inserted within the internal cavity **24*a* of the pressure unit 12*a*. The liner neck 66 extends out of the internal cavity 24*a* and is rolled over the open end 26*a* of the elastomeric body means 22*a* around enlarged portion 28*a*. The pressure unit 12*a*, containing liner means 62; support means 14*a*; and sealing member means 16*a*, carrying valve means 18*a*, are assembled as heretofore described. The annular portion 40*a* of sealing member means 16*a* still exerts a compressive force upon the enlarged portion 28*a* of elastomeric body means 22*a*. However, it is in sealing contact with the liner neck 66 rather than the open end 26*a* of elastomeric body means 22*a*. The above subcombination may be inserted into a container 20*a*** and attached thereto as previously described.

In operation, the apparatus 60 with liner means 62 operates similar to the apparatus 10 without a liner. However, the fluid to be dispensed is contained within liner means 62 and will not be contaminated by or contaminate the elastomeric material of pressure unit **12*a*. When fluid is injected into the apparatus 60, the liner body 64 will unfold and the pressure unit 12*a* will expand. The liner body 64 will engage the inner wall of the internal cavity 24*a* and will assume its size and shape. The inherent contracting force of the expanded pressure unit 12*a* will provide dispensing pressure through liner means 62**.

The upper portion of a second embodiment of a pressurized flow dispensing apparatus 70 with an alternate enlarged portion 72 of the pressure unit body 74, support means 76 and sealing member means 78 is illustrated in FIG. 5. This second embodiment 70 also includes valve means **18*b* and may also include a container 20*b* and liner means 62*b*. Valve means 18*b*, liner means 62*b* and container 20*b* are the same as the corresponding elements shown in FIGS. 1, 2, 3 and 4** and they have been designated with the corresponding numeral with the addition of the suffix b.

The pressure unit includes an elongate elastomeric body 74 formed with an internal cavity 80 which opens at one end 82 of the body 74. The elastomeric body 74 includes an enlarged portion 72 which surrounds the open end of the body 74. At the open end 82 of the body 74, the surface of the enlarged portion is rounded and merges into the wall of the internal cavity 80. Some inherent structural rigidity is provided to the open end 82 of the pressure unit body 74 due to the thickness of the enlarged portion 72 while additional structural support is obtained from support means 76. The enlarged portion 72 includes annular recess means 84 extending around its outer circumference to coact with support means 76 and sealing member means 78.

Support means 76 comprises an annular plate having a central opening surrounded by an inner rim 76', in which the enlarged portion 72 pressure unit body 74 may be received. The inner rim 76' of support means 76 fits within the recess 84 of the enlarged portion 72 of elastomeric body 74 to support the pressure unit body 74. When the inner rim 76' is received within recess means 84, support means 76 prevents the enlarged portion 72 of elastomeric body 74 from expanding outwardly.

Sealing member means 78 surrounds the opening into the internal cavity 80 and applies a compressive force to the open end 82 of the pressure unit body 74 to seal the opening. A compressive force applied by sealing member means 78 is resisted sufficiently by the enlarged portion 72 of the pressure unit body 74 to effect a sealing of the open end 82 due to the inherent structural rigidity of the enlarged portion 72 and the support provided to the enlarged portion 72 by support means 76. Sealing member means 78 includes an annular portion 86 which conforms to the shape of the open end 82 of the pressure unit body 74 and which applies the compressive force. Sealing member means 78 is maintained in position applying a compressive force to the one end 82 of the pressure unit body 74 by an inwardly projecting lip 88 received within recess means 84. Sealing member means 78 also includes an upstanding portion 90 in which valve means **18*b*** is sealably carried.

If a container **20*b* is used to house the fluid dispensing apparatus 70, the outer rim 76' of support means 76 is attached to the container 20*b***.

Liner means **62*b* may be used with the fluid dispensing apparatus 70 to prevent contamination between the product and the elastomeric material of the pressure unit body 74**.

To assemble the pressure unit body 74; support means 76; and sealing member means 78, which carries valve means **18*b*, of this second embodiment 70, the pressure unit body 74 is inserted through the central opening of support means 76 until the inner rim 76' of support means 76 snaps within recess means 84 of the enlarged portion 72 of the pressure unit body 74. Sealing member means 78 is positioned over the open end 82 of the pressure unit body 74, placed in compressive contact with the enlarged portion 72 of the pressure unit body 74, and maintained in such a sealing contact by snapping its lip 88 into recess means 84**.

If a container **12*b* is used, the outer rim 76' of support means 76** is attached to it.

If liner means **62*b* is used, the liner body 64*b* is folded and inserted into the internal cavity 80 before sealing member means 78 is joined to the apparatus. The liner neck 66*b* is laid over the open end 82 of the pressure unit body 74 and confined between it and sealing member means 78 to effect a sealing of the internal cavity 80**.

In operation, if no liner is used, this second embodiment 70 operates the same as the first embodiment 10 of FIGS. 1 and 2. If liner means **62*b* is used, it operates the same as the apparatus 60 of FIG. 4**.

Figure 6:
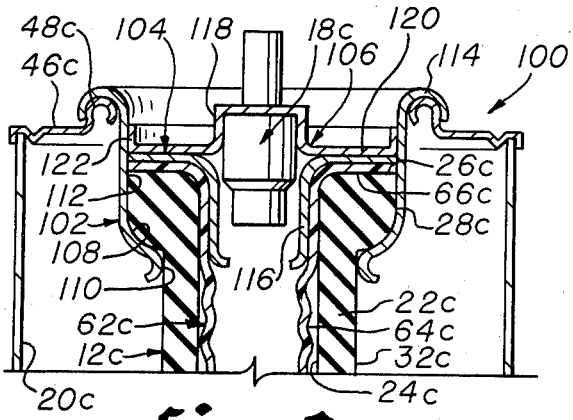
FIG. 6 is a fragmentary view in vertical cross section of the upper portion of a third embodiment with a modified support and sealing member.

A third embodiment of a pressurized fluid dispensing apparatus 100 with a modified support means 102, modified sealing member means 104, and including a separate valve carrying means 106 is illustrated, in a fragmenting view of the upper portion of the apparatus, in FIG. 6. These elements interact with the pressure unit **12*c* to provide a fluid tight arrangement around the open end 26*c* of the pressure unit body 22*c*. The pressure unit 12*c* and valve means 18*c* of this third embodiment may be the same as those used for the first embodiment 10**. They have been designated with the same numerals except for the addition of the suffix c.

The container **20*c*, if used, is also the same as in the first embodiment 10** and has the same numeral designation with the addition of the suffix c.

Liner means **62*c*, if used, is the same as in the alternate form 60** and has the same numeral designation with the addition of the suffix c.

Support means 102 supports the enlarged portion **28*c* of pressure unit 12*c* upon seating surface 108, contoured to conform to the shape of the enlarged portion 28*c*, which surrounds a central opening through which the elongate portion 32*c* of the pressure unit 12*c* can pass when it is relaxed. A rim 110 also surrounds the central opening and is curved away from seating surface 108. The rim 110 prevents damage to the elongate portion 32*c* of the pressure unit 12*c* both during insertion of the elongate portion 32*c* through the central opening and during expansion of the pressure unit 12*c*. Extending from the seating surface 108 is a cylindrical portion 112 of the support means 102. The cylindrical portion 112 engages valve cup means 106**, in a manner to be described, and maintains it in position as part of the fluid tight arrangement.

If a container **20*c* is used to house the apparatus 100, support means 102 is attached to the rim portion 48*c* of the container end plate 46*c* by a curved, downward facing lip 114 at the end of its cylindrical portion 112**.

Sealing member means 104 surrounds the opening into the internal cavity **24*c* and applies a compressive force to the enlarged portion 28*c* to effect a sealing of the opening. Sealing member means 104 includes downward depending skirt means 116 projecting into the internal cavity 24*c*. Skirt means 116 directs fluid product within the internal cavity 24*c* to valve means 18*c* and, if liner means 62*c* is used, prevents it from contacting and interfering with the operation of valve means 18*c***.

Valve cup means 106 sealably carries valve means **18*c* in a central upstanding valve stem 118 and retains sealing member means 104 in sealing engagement around the opening into the internal cavity 24*c*. A sealant between valve cup means 106 and sealing member means 104 prevents leakage from within the internal cavity 24*c* between these two elements. An annular portion 120 of valve cup means 106 engages and retains sealing member means 104 in its position, and an outer circumferential rim 122 fixedly engages support means 102, as by a frictional press fit between it and the cylindrical portion 112 of support means 102, to maintain the pressure unit 12*c*, support means 102, sealing member means 104 and valve cup means 106** in their fluid tight arrangement.

If liner means **62*c* is used to prevent contamination, its body 64*c* is positioned within the internal cavity 24*c*** while its neck 66c is folded over the open end 26c of the pressure unit body 22c and confined between sealing member means 104 and the pressure unit body's enlarged portion 28c.

To assemble the elements of this third embodiment 100, the elongate portion 32c of pressure unit 12c is inserted through the central opening of support means 116 unit its enlarged portion 28c seats upon the seating surface 108. Sealing member means 104 is positioned over the pressure unit body's open end 26c with skirt means 116 projecting into the internal cavity 24c. A sealant may be placed on the annular portion 120 of valve cup means 106, and valve cup means 106, carrying valve member means 18c, is pressed into position on top of sealing member means 104 until the enlarged portion 28c of the pressure unit 12c is sufficiently compressed by sealing member means 104 to effect a seal with it. A frictional fit between the valve cup's circumferential rim 122 and the support's cylindrical portion 112 fixedly engages one to the other and maintains valve cup means 106 in position.

If the apparatus is housed within a container 20c, the downward facing lip 114 of support means 102 is fitted over the container rim 48c.

If liner means 62c is used, it is positioned within the internal cavity 24c before sealing member means is placed over the open end 26c of the pressure unit body 22c.

The operation is similar to the operation of the previously described embodiments.

Figure 7:
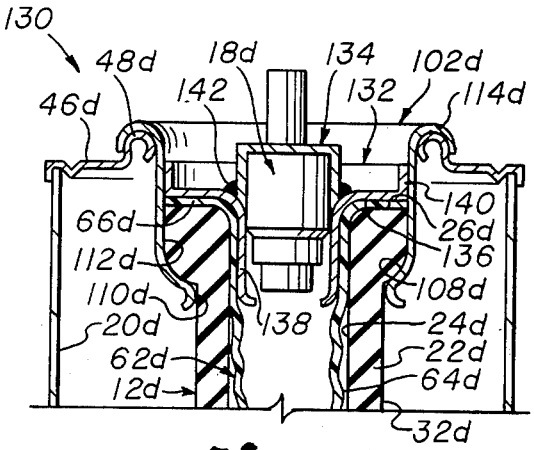
FIG. 7 is a fragmentary view in vertical cross section of the upper portion of a fourth embodiment showing another form of support and sealing member.

A fragmentary view of the upper portion of another form of a pressurized fluid dispensing apparatus 130 is shown in FIG. 7. In this form 130, the pressure unit 12d, support means 102d and valve means 18d—and, if used, the container 20d and liner means 62d—are identical to the corresponding elements in the third embodiment 100. These elements will not be further described. Their numeral designation corresponds to the numeral designation of the corresponding elements in FIG. 6 with the addition of the suffix d.

The elements that are different from the elements of the third embodiment 100 are sealing member means 132 and valve cup means 134.

Sealing member means 132 includes an annular portion 136 surrounding and effecting a seal of the opening into the pressure unit's internal cavity 24d. Depending skirt means 138 of sealing member means 132 projects into the internal cavity 26d to direct fluid to valve means 18d and prevent liner means 62d from contacting and interfering with valve means 18d. A fixed engagement between sealing member means 132 and support means 102d maintains sealing member means 132 in position. The fixed engagement is provided by a vertical rim 140 of sealing member means 132 frictionally engaging the cylindrical portion 112 of support means 102d.

Valve cup means 134 is connected to sealing member means 132 and sealably carries valve means 18d. The illustrated valve cup means 134 is a thimble having an external diameter approximately equal to the internal diameter of the sealing member's depending skirt means 138. Valve cup means 134 is inserted into the mouth of depending skirt means 138 and connected thereto, as by weldment 142, to prevent fluid flow between valve cup means 134 and sealing member means 132.

The fourth embodiment 130 is assembled by positioning pressure unit 12d within support means 102d and press fitting sealing member means 132 within support means 102d. Valve cup means 134 is then inserted and connected to sealing member means 132.

If used liner means 62d and container 20d, are assembled with the other elements in a manner similar to that previously described.

Figure 8:
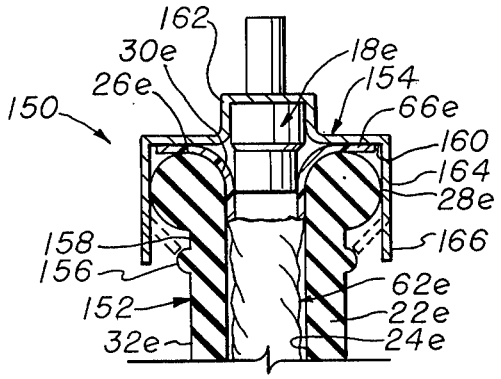
FIG. 8 is a fragmentary view in vertical cross section of the upper portion of fifth embodiment showing a modification of the pressure unit and sealing member of the second embodiment before assembly with the support and container.
Figure 9:
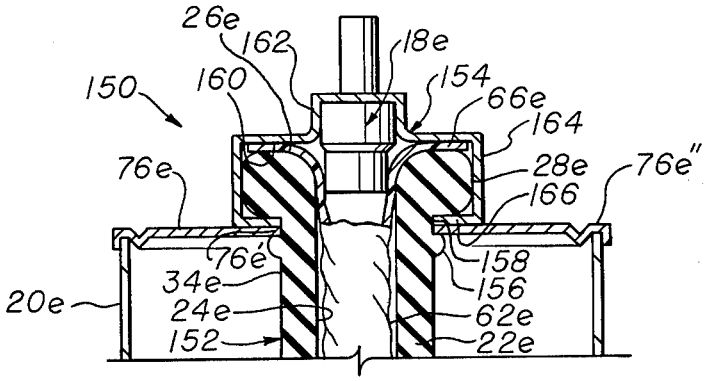
FIG. 9 is a fragmentary view in vertical cross section of the upper portion of the fifth embodiment after assembly.

A modification of the upper portion of the apparatus shown in FIG. 5 is illustrated in FIGS. 8 and 9. In this modification 150, the support means 76e and valve means 18e—and, if used, container means 20e and liner means 62e—are identical to the corresponding elements in FIG. 5. They will not be further described. Their numeral designation corresponds to the numeral designation of FIG. 5 with the addition of the suffix "e". The modified elements are the pressure unit 152 and sealing member means 154.

The pressure unit 152 is modified to include an engaging means 156 on the exterior of the body 22e but otherwise identical to the pressure unit shown in FIG. 3. The numerous designation of the pressure unit 152 is the same as the numerous designation shown in FIG. 3 with the addition of the suffix e. Engaging means 156 coacts with support means 76e to permit an easy, snap fit assembly of the pressure unit with a container 20e. The illustrated engaging means 156 is an annular ridge of elastomeric material formed integrally with the pressure unit body 22e spaced below the enlarged portion 28e. Recess means 158 are thus formed between the annular ridge of material 156 and the enlarged portion 28e.

Sealing member means 154 includes an annular portion 160 to surround and effect a seal of the opening into the pressure unit's interior cavity 24e. A central upstanding valve cup means 162 of sealing member means 154 carries valve means 18e. Sealing member means 154 also includes a cylindrical portion 162 depending from the annular portion 160 which surrounds the pressure unit's enlarged portion 28e and which includes a lip 166 adapted to be folded inwardly and upwardly to engage, combine and compress the enlarged portion 28e so that the annular portion 160 affects a seal of the open end 26e of the pressure unit 152. When the lip 166 of the sealing member means' cylindrical portion 164 has been folded inward and upward, it is received within the recess 158 (see FIG. 9).

A fluid tight arrangement around the opening into the pressure unit's internal cavity 24e is obtained in modified embodiment 150 with just the pressure unit 152 and sealing member means 154—and liner means 62e, if used.

If the apparatus is housed within a container 20e, the pressure unit 152 is supported therein by support means 76e. The inner rim 76e' of support means 76e snaps over the pressure unit's engaging means 156 and is thereafter engaged thereby and combined within recess 158.

To assemble this modified embodiment 150, sealing member means 154, carrying a valve means 18e, is placed over the pressure unit's open end 26e. The lip 166 of sealing member means' downwardly depending cylindrical portion 164 is folded inward and upward to engage and compressibly confined the pressure unit's enlarged portion 28e between it and the annular portion 160 of the sealing member means 154.

If a liner means 62e is to be used, it is placed within the internal cavity 24e with its neck 66e folded over the open end 26e of the pressure unit 152 before the sealing member means is placed over the pressure unit's open end 26e.

To house the apparatus within a container 20e, the elongate portion 32e of the pressure unit 152 is inserted through support means 76e until engaging means 156 snaps through the inner rim 76e'. Support means' outer rim 76e' is attached to the container 20e.

The operation of this embodiment 150 is similar to the operation of previously described embodiments.

Figure 10:
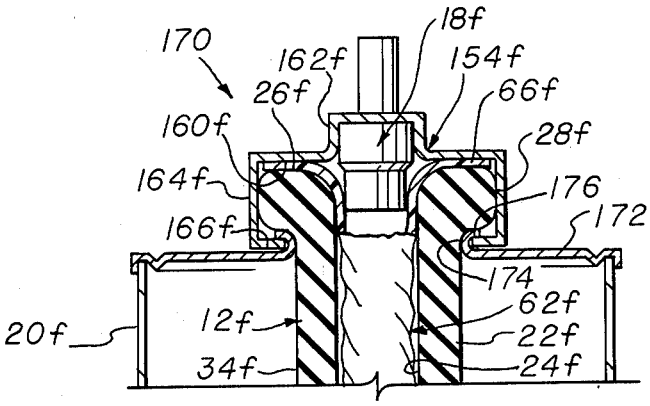
FIG. 10 is a fragmentary view in vertical cross section of the upper portion of a modification of the embodiment shown in FIGS. 8 and 9.

FIG. 10 illustrates another form 170 of the modified embodiment shown in FIGS. 9 and 10 which does not require an engaging means on the pressure unit 12f. The pressure unit 12f, valve means 18f, and if used, the container 20f and liner means 62f are the same as the corresponding components illustrated in FIG. 4 and having corresponding numeral designations with the addition of the suffix "f".

Sealing member means 154f is the same as sealing member means 154 in FIGS. 8 and 9 except that the lip 166 is shorter. Its numeral designation also has the addition of the suffix "f".

Support means 172 is changed from that shown in the previous embodiment. It has a central opening 174 sized permit the pressure unit's elongate portion 34f to pass therethrough when the pressure unit 12f is relaxed. Support means 172 also includes a central rim 176 which is rolled upward and away from the central opening 174.

To assemble this form of the apparatus the liner means 62f, if used, is placed within the internal cavity 24f with its neck 66f rolled over the open end 26f of the pressure unit 12f. The pressure unit's elongate body 34f is inserted through the central opening 174 of the support means 172 until its enlarged portion 28f rests upon the curved rim 176 of support means 172. Sealing member means 154f is placed over the pressure unit's enlarged portion 28f with its annular portion 160f contacting the opened end 26f of the pressure unit 12f. Its lip 166f is folded inward and upward until it engages the rim 176 of support means 172 and compressibly confines the enlarged portion 28f of the pressure unit 12f. This confinement maintains the pressure unit 12f and sealing member means 154f in position as part of the fluid tight arrangement with support means 172. If a container 20f is used, the outer edge of support means 172 is attached thereto.

The operation of this form 170 is similar to the operation of other embodiments.

Referring to FIGS. 11 and 12 there is shown a still further embodiment 180 of the invention including modified forms of the pressure unit 182, support means 184 and sealing member means 186. The pressure unit 182 throughout its elongate lower portion 183 is substantially the same as that illustrated in FIG. 3 and includes a cylindrical body formed with an internal cavity 24g open at its upper end and closed at its lower end. However, the enlarged portion at the upper end of the pressure unit is somewhat modified including a downwardly facing generally horizontal annular shoulder 188 and a specially configured upper surface including an inset circumferential shoulder 190 and two circumferential raised portions or peaks 192 and 194, respectively, separated by an annular declivity 196. The inner raised portion 194 serves the same function as the single rounded upper surface 30 of the FIG. 3 embodiment of the pressure unit; that is to provide a line of maximum compression when engaged by the lower surface of the sealing member for maximum sealing efficiency. The outer rim or raised portion 192 is adapted to coact with a corresponding groove 210 in the sealing member 186 to provide resistance to horizontal movement or "creep" of the pressure unit when filled with pressurized fluid.

The modified support means 184 includes an upper generally cylindrical wall portion 198 and generally horizontal annular shoulder 200 which extends radially inwardly and terminates in a curved downwardly extending portion 202 which defines a circular opening 204 of sufficient diameter to accommodate the lower portion 183 of the pressure unit 182.

The modified sealing member means 186 includes a raised central portion 206 for accommodating the valve means 18g and a generally flat lower radially extending portion 208 terminating in a downwardly facing annular groove or rim portion 210.

With the parts in their fully assembled position, as illustrated in FIG. 12, the lower portion 183 of the pressure unit 182 is received within the opening 204 of support member 184, with the lower horizontal shoulder 188 of the pressure unit resting upon the upper horizontal surface 200 of the support member. The downwardly and outwardly extending curved portion 202 of the support member prevents the elastomeric material of the pressure unit from being cut or damaged by the support member when the unit is pressurized. The sealing member 186 is pressed onto the top of the pressure unit 182 and retained in place by crimping the upper cylindrical portion 198 of the support member 184 over the top of rim 210 on the sealing member. Raised portion 192 of the pressure unit is received within the downwardly facing rim 210 of the sealing member to prevent horizontal movement of the pressure unit. Raised portion 194 is placed into firm sealing contact with the horizontal surface 208 of sealing member 186. A double line seal is therefore accomplished between the pressure unit and the sealing member where the two raised portions 192 and 194 are placed under maximum compression. In the event that a liner is used with this embodiment, its upper portion will be held in sealing engagement between the raised portion 194 of the pressure unit and the lower surface 208 of the sealing member.

From the foregoing it can be seen that the objects of this invention have been obtained. A pressurized fluid dispensing apparatus has been provided which does not require that the elastomeric pressure unit be bonded to any component. The assembly of the apparatus is simplified and may be accomplished with only frictional press fittings or crimp fittings. Alternatively a single bond between metal components may be utilized.

The foregoing disclosure and description of the invention are illustrated and explanatory thereof; and various changes in the size, shape and materials, as well as changes in the details of the illustrated construction, may be made within the scope of the appended claims without departing from the spirit of the invention.

What is claimed is:

1. In an apparatus for pressurized dispensing of fluids, the subcombination comprising:

a pressure unit having elongate elastomeric body means with an internal cavity opening from the upper end thereof, for containing fluids to be dispensed and for supplying substantially the entire dispensing pressure for such fluids;

said pressure unit body including an elongate lower portion of reduced outside dimension and preselected wall thickness and an upper portion of enlarged outside dimension and substantially greater wall thickness than said lower portion;

support means engaging the lower outside surface of said enlarged portion for supporting said pressure unit on said support means from said enlarged portion;

valve means sealably engaging said pressure unit and closing the opening into said internal cavity, for selectively dispensing fluids from said cavity;

sealing member means for supporting said valve means and applying a force to compress said enlarged portion between said valve means, said support means and said sealing member means to effect a sealing of said opening and prevent flow of fluid from said internal cavity, said sealing member means and said support member means being separate parts initially vertically movable with respect to each other to effect said compression of said enlarged portion therebetween and being deformable whereby said sealing member means, support member means and valve means may be held in sealing relationship to said enlarged portion by crimping said sealing member means and said support member means, one of said sealing member means and support member means including means for attachment of said subcombination to a container.

2. The apparatus according to claim 1 wherein the upper surface of said enlarged portion is rounded and the surface of said sealing member means adapted to contact said upper surface is relatively flat, whereby an annular area of maximum compression is provided for effecting a line seal.

3. The apparatus according to claim 1 wherein the wall thickness of said elongate lower portion of said elastomeric body is at least approximately one-tenth of an inch.

4. In an apparatus for pressurized dispensing of fluids, the subcombination comprising:

a pressure unit including elastomeric body means having an internal cavity extending downwardly from the upper end of said body means for containing the fluid to be dispensed and for supplying substantially the entire dispensing pressure for said fluid;

said elastomeric body including an enlarged diameter portion on said upper end and an elongate lower portion of substantially uniform wall thickness and reduced outside diameter;

support means for supporting said pressure unit from said enlarged portion;

sealing member means surrounding the opening into said internal cavity and applying a force to the surface of said enlarged portion to compress said enlarged portion between said support means and said sealing member means to effect a sealing of said opening to prevent fluid flow from within said internal cavity;

said sealing member means and said support member means being separate parts initially vertically movable with respect to each other to effect said compression of said enlarged portion therebetween; and means for attaching said sealing member means to said support means to maintain said vertical compressive force on said enlarged portion, the upper surface of said enlarged diameter portion of said pressure unit including two raised annular areas and said sealing member means including a concave circumferential groove for receiving one of said raised annular areas and a flat surface for maximum compressive engagement with the other of said raised annular areas.

5. The apparatus according to claim 4 wherein said enlarged upper portion on said pressure unit has a wall thickness at least approximately twice that of said elongate lower portion.

6. The apparatus according to claim 5 wherein said elongate lower portion of said pressure unit has a wall thickness of at least approximately one-tenth inch and said upper enlarged portion has a wall thickness of at least approximately one-fifth inch.

7. The apparatus of claim 4 additionally including:

valve means carried by said sealing member means for selectively dispensing fluid from within said internal cavity.

8. The apparatus of claim 4 additionally including:

valve cup means in fixed engagement with said support means for retaining said sealing member means in position.

9. The apparatus of claim 8 additionally including:

valve means carried by said valve cup means for selectively dispensing fluid from said internal cavity.

10. In an apparatus for pressurized dispensing of fluids, the subcombination comprising:

a pressure unit of elongate elastomeric body means having an internal cavity of substantially uniform inside diameter extending downwardly from the upper end thereof for containing the fluid to be dispensed, an elongate lower portion of substantially uniform wall thickness and an enlarged diameter upper portion of substantially increased outside diameter formed on the upper end thereof and surrounding the opening into internal cavity and for supplying substantially the entire dispensing pressure for said fluids, said pressure unit having an annular ridge of elastomeric material formed integrally with the pressure unit body and spaced below the enlarged portion and adapted to act as means for retaining said pressure unit within a container;

support means for supporting said pressure unit from said enlarged diameter upper portions;

liner means disposed within said internal cavity for containing the fluid to be dispensed, said liner means including neck means extending out of the opening of said internal cavity and folded over said upper end of said body means;

sealing member means surrounding the opening into said internal cavity for applying a force to the neck of said liner means and to the enlarged portion to compress said neck of said liner means and said enlarged portion between said support means and said sealing member means to effect a sealing of said opening to prevent fluid flow from within said liner means, said sealing member means and said support member means comprising a single part having a first nondeformable portion for providing one of said sealing member means and said support means and a second deformable portion adapted to be deformed about said enlarged portion of said pressure unit for providing the other of said support member means and said sealing member means and for compressively confining said enlarged portion of said pressure unit therebetween.

11. The apparatus according to claim 10 wherein said liner means is formed of relatively inelastic material and is relatively thin-walled compared to the wall thickness of said elastomeric pressure unit.

12. The apparatus of claim 10 additionally including valve means carried by said sealing member means for selectively dispensing fluid from said internal cavity.

13. The apparatus of claim 12 wherein said sealing member means includes depending skirt means projecting into the neck of said liner means.

14. An apparatus for pressurized dispensing of fluids comprising:

a container;

a pressure unit for supplying substantially the entire dispensing pressure for said fluids including an elongate elastomeric body having an internal cavity of substantially uniform inside diameter extending downwardly from the upper end thereof, an elongate lower portion of selected wall thickness and an upper portion of substantially increased wall thickness and outside diameter, said upper portion having a raised annular area in surrounding relationship to the opening to said internal cavity;

liner means of greatly reduced wall thickness as compared to the wall thickness of the lower portion of said elastomeric body means being positioned within said internal cavity for preventing contamination of fluid to be dispensed by said elastomeric body means, said liner means having a neck portion extending out of the opening of said internal cavity and folded over said raised annular area on the upper end of said elastomeric body means;

support means attached to said container for supporting said pressure unit within said container from said enlarged portion;

valve means sealably engaging said pressure unit and closing the opening into said internal cavity, for selectively dispensing fluids from said cavity;

sealing member means supporting said valve means and applying a force to said liner neck and the upper portion of said pressure unit to compress said liner neck and said upper portion of said pressure unit between said valve means, said sealing member means and said support means to effect a sealing of said liner means to the valve means and said sealing member means to prevent fluid flow from within said internal cavity, said sealing member means and said support member means being separate parts initially vertically movable with respect to each other to effect said compression of said enlarged portion therebetween and being deformable whereby said sealing member means, support member means and valve means may be held in sealing relationship to said enlarged portion by crimping said sealing member means and said support member means, one of said sealing member means and support member means including means for attachment of said subcombination to a container.

* * * * *